US008764229B2

(12) United States Patent
Dalsgaard et al.

(10) Patent No.: US 8,764,229 B2
(45) Date of Patent: Jul. 1, 2014

(54) OPTICAL LENS SECURING ASSEMBLY FOR AN ILLUMINATION DEVICE

(75) Inventors: Carsten Dalsgaard, Silkeborg (DK); Uffe Kjærgaard Toft, Højbjerg (DK)

(73) Assignee: Martin Professional A/S, Aarhus N. (DK)

( * ) Notice: Subject to any disclaimer, the term of this patent is extended or adjusted under 35 U.S.C. 154(b) by 0 days.

(21) Appl. No.: 13/587,408

(22) Filed: Aug. 16, 2012

(65) Prior Publication Data

US 2013/0021796 A1 Jan. 24, 2013

Related U.S. Application Data

(63) Continuation of application No. PCT/DK2011/050041, filed on Feb. 11, 2011.

(30) Foreign Application Priority Data

Feb. 16, 2010 (DK) ..... 2010 00128
Feb. 11, 2011 (WO) ..... PCT/DK2011/050041

(51) Int. Cl.
*F21V 7/00* (2006.01)
*F21V 17/16* (2006.01)
*F21Y 105/00* (2006.01)

(52) U.S. Cl.
CPC ..... *F21V 17/16* (2013.01); *F21V 17/164* (2013.01); *F21V 7/0083* (2013.01); *F21Y 2105/001* (2013.01); *F21Y 2105/003* (2013.01)
USPC ..... 362/237; 362/244; 362/235; 362/241

(58) Field of Classification Search
CPC ..... F21V 17/16; F21V 17/164; F21V 17/08; F21V 17/10; F21V 17/14; F21V 5/007; F21V 7/0083; F21Y 2105/001; F21Y 2105/003
USPC ..... 362/249.02, 311.02, 440, 455, 362/236–238, 240, 244
See application file for complete search history.

(56) References Cited

U.S. PATENT DOCUMENTS 7,766,509 B1 * 8/2010 Laporte ..... 362/249.02
8,157,414 B2 * 4/2012 Schaefer et al. ..... 362/245
(Continued)

FOREIGN PATENT DOCUMENTS

EP 2103865 9/2009
WO WO2004/097999 11/2004
(Continued)

OTHER PUBLICATIONS

International Search Report; International Application No. PCT/DK2011/050041; International Filing Date Feb. 11, 2011; 3 pages.

*Primary Examiner* — Robert May
(74) *Attorney, Agent, or Firm* — Blank Rome LLP

(57) ABSTRACT

The present invention relates to lens assembly for an illumination device comprising a number of optical lenses and a lens holder comprising a mounting plate having a number of holes, said number of holes being adapted to accommodate said lenses. At least one of said holes is at least partially surrounded by a number of resilient fingers extending backward from the mounting plate, said resilient fingers being adapted to engage with one of said lenses and secure said lens in said holes. The present invention relates also to an illumination device comprising such lens assembly and a method of manufacturing the illumination device.

16 Claims, 9 Drawing Sheets

(56) References Cited

U.S. PATENT DOCUMENTS

| | | | | |
|---|---|---|---|---|
| 2004/0070984 | A1 | 4/2004 | Smith et al. | |
| 2008/0273327 | A1* | 11/2008 | Wilcox et al. | 362/267 |
| 2009/0310356 | A1* | 12/2009 | Laporte | 362/239 |
| 2012/0063135 | A1* | 3/2012 | Jurik et al. | 362/249.02 |

FOREIGN PATENT DOCUMENTS

| | | |
|---|---|---|
| WO | WO2009/033051 | 3/2009 |
| WO | WO2009/114587 | 9/2009 |

* cited by examiner

OPTICAL LENS SECURING ASSEMBLY FOR AN ILLUMINATION DEVICE

RELATED APPLICATION

The present invention is a continuation application of International Application No. PCT/DK2011/050041, filed on Feb. 11, 2011, which claims priority to Danish Patent Application No. DK PA2010000128, filed on Feb. 16, 2010. The disclosures of which are incorporated by reference in this application in their entity.

FIELD OF THE INVENTION

The present invention relates to lens assembly for an illumination device comprising a number of optical lenses and a lens holder comprising a mounting plate having a number of holes, said number of holes being adapted to accommodate said lenses. The present invention relates also to an illumination device comprising such lens assembly and a method of manufacturing the illumination device.

BACKGROUND OF THE INVENTION

Moving head lighting fixtures are commonly known in the art of lighting and especially entertainment lighting. A moving head light fixture typically comprises a head having a number of light sources which creates a light beam and number of light effect means adapted to create various light effects. The head is rotatable connected to a yoke and the yoke is rotatable connected to a base and the result is that the head can rotate and direct the light beam in all directions.

The competition in the market has traditionally been based on the optical performance of the moving head such as light output, number of light effects, color mixing etc. The competition in the market has lately changed such that parameters such as quality, serviceability and price have become the most important factors. There is thus a need for a competitive moving head lighting fixture with regard to quality, serviceability and price.

US2009154165 discloses a device for influencing a light beam including a primitive element and a housing which is arranged on a rotatable arm and which is rotatable with respect to the primitive element by means of one of the several drive units, and into which a light source for generating a light beam may be introduced, wherein at least one part of the control electronics for operating the device is arranged in the rotatable arm or in the housing.

EP 1898145 discloses a moving head projectors comprising a base to which base a yoke is rotationally connected, which yoke is rotationally connected to a head, which head comprises a light source placed partly inside reflective means, which reflective means forms a light beam, which light beam passes through light forming means, which light beam furthermore passes through at least one lens before the light beam leaves the projector.

FR 2838178A discloses a spotlight having a face which supports a large number of red, green and blue light-emitting diodes which are controlled by an electronic circuit board at the rear to produce various color shades. The spotlight housing may be rotated about a horizontal axis by a motor and toothed belt and about a vertical axis by a motor and toothed belt.

EP 2103865 shows a system for rotating the head of a lighting fixture. A motor comprises a driving wheel, which driving wheel drives a belt, which belt 14 is kept tight by a belt tensioner. The belt tensioner comprises a fixture and a tensioner wheel, which fixture is held under tension by a spring. An absolute encoding module comprises an input wheel driven by the belt. The input wheel rotates a first axle, which first axle rotates a second axle at a different speed. Furthermore, the belt drives a wheel connected to a head.

The prior art moving heads comprise many components and are thus rather complicated to manufacture which increases the price of the moving head and further complicates the serviceability of the moving head.

DESCRIPTION OF THE INVENTION

The object of the present invention is to solve the above-described limitations related to prior art. This is achieved by illumination device, method and lens assembly as described in the independent claims. The dependent claims describe possible embodiments of the present invention. The advantages and benefits of the present invention are described in the detailed description of the invention.

DESCRIPTION OF THE DRAWING

FIG. 1*a* is a perspective view and FIG. 1*b* is an exploded view;

DETAILED DESCRIPTION OF THE INVENTION

The present invention is described in view of a moving head lighting fixture including a number of LEDs that generate a light beam, however the person skilled in the art realizes that the present invention relates to illumination devices using any kind of light source such as discharge lamps, OLEDs, plasma sources, halogen sources, fluorescent light sources, etc.

Figure 1A:
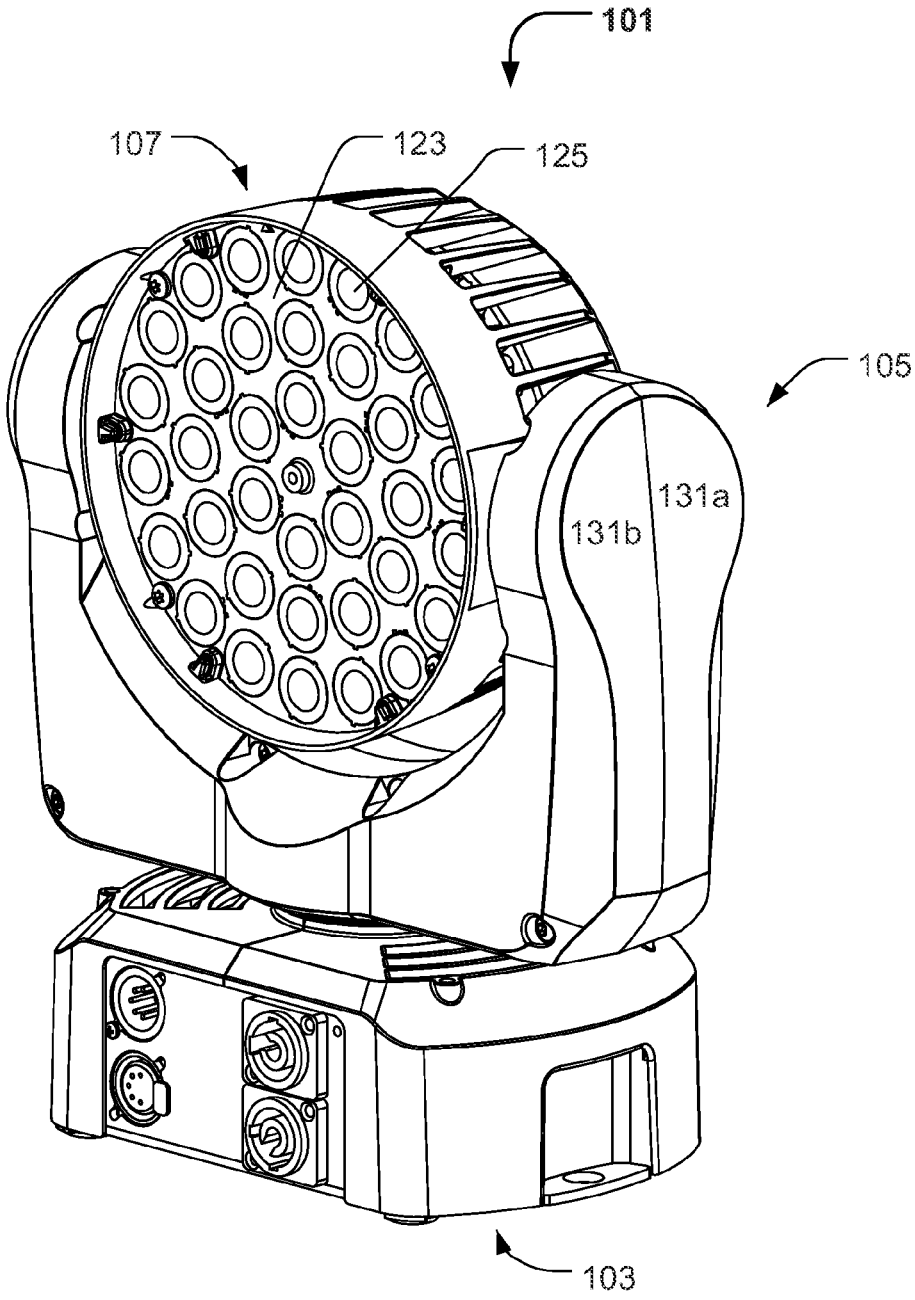
FIGS. 1*a* and 1*b* illustrate an illumination device according to the present invention where
Figure 1B:
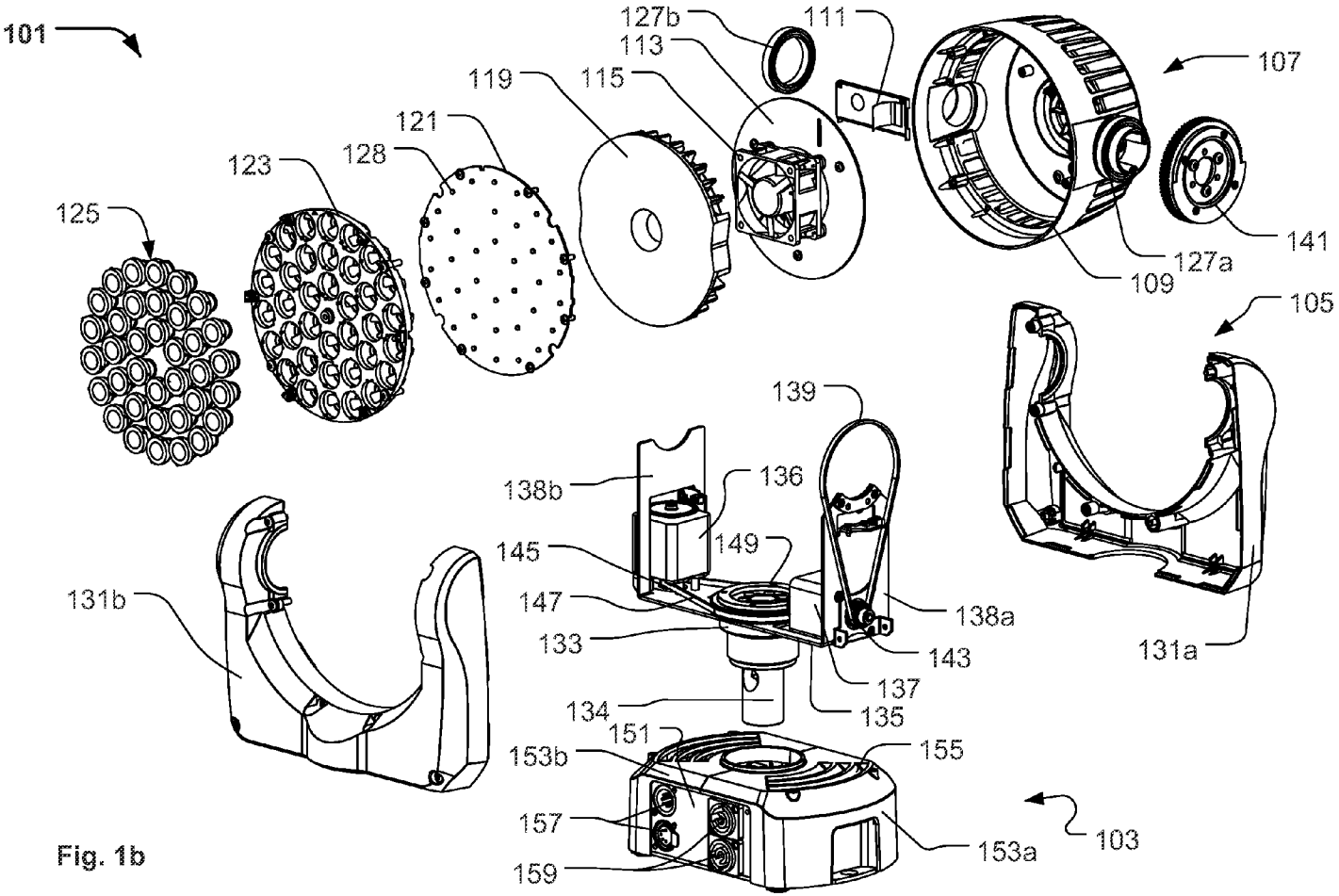

FIGS. 1*a* and 1*b* illustrate an illumination device according to the present invention where FIG. 1*a* is a perspective view and FIG. 1*b* is an exploded view. The illumination device is a moving head lighting fixture 101 comprising a base 103, a yoke 105 rotatable connected to the base and a head rotatable connected 107 to the yoke.

In the illustrated embodiment, the head is embodied as a "bucket" shaped head outer shell 109 wherein a display 111, main PCB (Printed Circuit Board) 113, a fan 115, a heat sink 119, an LED PCB 121, a lens assembly are stacked. The lens assembly comprises a lens holder 123 and a lens array 125. The head is rotatable connected to the yoke by two tilt bearings 127*a* and 127*b*, which are supported by the yoke as described in connection with the yoke. The LED PCB 121 comprises a number of LEDs 128 emitting light and which in cooperation with the lenses 125 in the lens array generate a light beam. The main PCB comprises controlling circuits and driving circuits (not shown) for controlling the LEDs as known in the art of illumination devices. The main PCB comprises further a number of switches (not shown) which extend through a number of holes in the head outer shell 109. The switches and display act as a user interface allowing a user to communicate with the moving head lighting fixture.

The yoke 105 comprises two yoke shell parts 131*a* and 131*b* that are interlocked across the entire width of the yoke. The yoke can be compared to the yoke of prior art moving head lighting fixtures and can as a consequence be manufactured very fast and thereby reduce the price of the moving head lighting fixture. The two yoke shells 131*a* and 131*b* are interlocked across the entire width of the yoke along an edge, meaning that the two yoke shell parts are brought together in a locked position where the yoke shell parts have at least one pair of edges that are positioned adjacent to each other whereby the yoke shells form a tight enclosure and adds static strength to the construction. The yoke shell parts can be interlocked by fastening means such as screws, adhesive, or other kinds of engaging means. The entire width may be defined as the cross section having the largest dimension. This provides a stiff yoke construction as the yoke shell parts are interlocked over a large dimension. The manufacturing process of this yoke is very fast since the components, which are to be positioned within the yoke, can be arranged in a first yoke shell part 131*a* whereafter the second yoke shell part 131*b* can locked to the first yoke shell part 131*a*. The yoke shell parts form a monocoque shell which supports at least a part of the structural load provided to the yoke. The strength of the interior yoke (metal) structure, which normally takes up the entire structural load in prior art yokes, can thus be reduced for instance by providing simpler structures or by reducing the thickness of the (metal) structure. The interior yoke structure can even in some embodiment be completely omitted. The cost of the interior yoke structure can thus be reduced as a simpler structure can be provided and less material is needed in order to provide proper support of the yoke. The yoke shell parts 131*a* and 131*b* further fit together across the entire width of the yoke whereby it is easier to ensure that the yoke shell parts are locked together in a proper way. This can for instance be achieved by providing engaging means which ensure that the yoke shell parts only can be locked together in one particular way. The engaging means used in the illustrated embodiment can be seen in FIGS. 3*a* and 3*b*. This decreases the probability that the yoke shell parts are mounted wrongly which increases the quality of the product. The yoke shell parts can further be identical which decreases the costs even more as only one molding tool is needed and the manufacturing process is further simplified as there is no need to keep track of two different yoke shell parts.

The yoke shell parts are further connected to a pan bearing 133 rotatable connected to the base 103 through a shaft 134. The yoke comprises in this embodiment a metal frame 135 whereto a pan motor 136 and tilt motor 137 are arranged. The tilt motor 137 is arranged on a first arm 138*a* of the metal frame and connected to the tilt bearing 127*a* through a tilt belt 139. Tilt bearing 127*a* comprises further a toothed wheel 141 which is fixed to the rotating part of tilt bearing 127*a* and the head 107. The tilt motor comprises also a toothed wheel 143 and the tilt belt 139 is connected to the toothed wheel 141 of the tilt bearing and the toothed wheel 143 of the motor. The tilt belt comprises also a number of teeth (not shown) adapted to engage the toothed wheels 141 and 143. The tilt motor will as a consequence be able to rotate the head in relation to the yoke. It is to be understood that the tilt belt connection between the tilt motor and tilt bearing also can be embodied without the use of engaging teeth.

The pan motor 136 is arranged on a second arm 138*b* of the metal frame 135 and connected to the pan bearing 133 through a pan belt 145. The pan bearing and pan motor both comprise a toothed wheel (145 and 147 respectively) interconnected by a toothed pan belt 149. The toothed wheel 145 of the pan bearing is fixed in relation to the base 103 and the pan motor can thus rotate the yoke in relation the base. The metal frame makes it possible to mount the components which are to be positioned inside the yoke, such as pan motor, tilt motor, pan bearing, tilt bearing and other electronic or mechanical devices, before mounting the yoke shell parts. The metal frame is a bent one-sheet metal plate which reduces costs since the metal frame can be bent by a machine as known in the art of metal production. The skilled person will however realize that the metal frame can be omitted in other embodiments and that the components which are to be positioned inside the yoke can be mounted directly onto the yoke shell parts prior to locking the yoke shell parts together. This can for instance be achieved by providing mounting guides such as flanges, spacers or holes in the yoke shell parts. The mounting guides can for instance be molded as a part of the yoke shell parts.

The base 103 comprises a one-sheet metal main base frame 151 and two base shell parts 153*a* and 153*b*. The two base shell parts are arranged on the metal main base frame and have vent holes 155 on top for air cooling. The base further comprises 5-Pin XLR male and female connectors 157 for DMX signals as known in the art; input and output power connectors 159, power supply PCB's (not shown) and fan (not shown).

Figure 2:
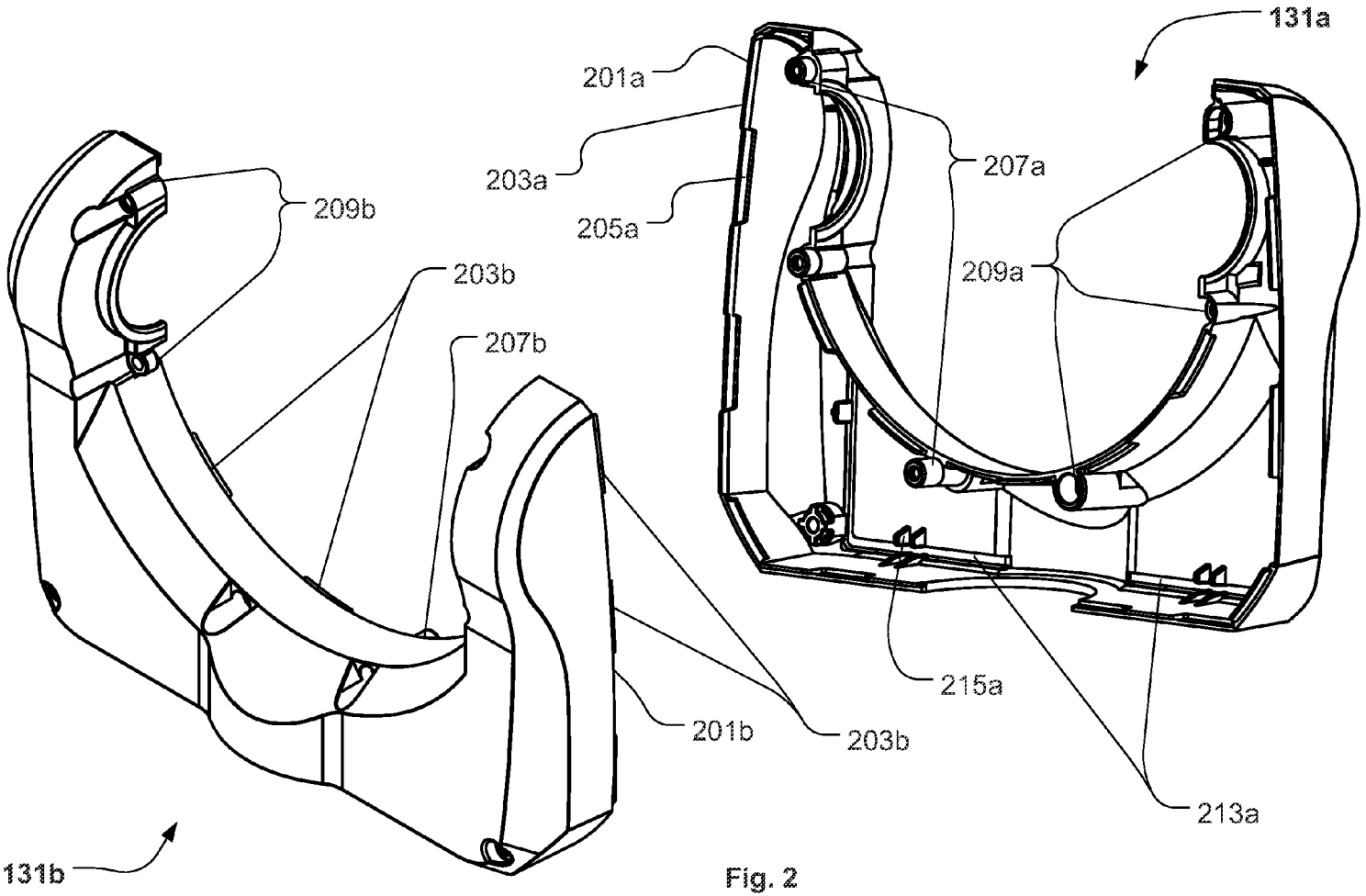
FIG. 2 illustrates a perspective view of two yoke shell parts 131*a* and 131*b* used in the illumination device in FIG. 1*a* and 1*b;*

FIG. 2 illustrates a perspective view of the two yoke shell parts 131*a* and 131*b*. The yoke shell parts are molded in a plastic material and are identical, which reduces manufacturing costs as only one molding tool is needed. The yoke shell parts 131*a* and 131*b* are interlocked along a locking edge 201*a* and 201*b* of each yoke shell part. The locking edge extends across the entire width of the yoke. The entire width may be defined as the cross-section having the largest dimension. This provides a stiff yoke construction as the yoke shell parts are interlocked over a large dimension. The stiffness of the construction is further increased due to the fact the locking edges 201*a* and 201*b* comprises at least two locking edge parts which are perpendicular to each other, as the bottom part of the yoke shell parts are substantially horizontal (with respect to the base) and the arm parts of the yoke shell parts are substantially vertical (with respect to the base). The monocoque shell constituted by the two yoke shell parts is thus capable of supporting structural loads applied to the yoke and also resist twisting and bending.

The yoke shell parts comprise engaging means adapted to engage with the other interlocked yoke shell part. The engaging means function as guides which ensure that the two yoke shell parts only can be locked together in the correct way. In the illustrated embodiment, the engaging means are embodied as a number of flanges 203*a* and 203*b* protruding from the locking edges 201*a* and 201*b* respectively. The flanges are adapted to engage with a corresponding number of recesses 205*a* (the recesses of yoke shell part 131*b* is not visible) in the locking edge of the other yoke shell parts. In the illustrated embodiment, the protruding flanges and recesses are positioned asymmetrically around the center of the yoke such that each flange will engage with an opposite recess when the two yoke shell parts are positioned with the locking edges 201*a* and 201*b* in front of each other. The engaging means are further embodied as number of bosses 207*a* and 207*b* protruding from the locking edges 201*a* and 201*b* respectively and a corresponding number of mating bores 209*a* and 209*b* integrated in the locking edges 201*a* and 201*b* respectively. The bores are further adapted to accommodate screws which are tightened into the boss e.g. into a threaded hole or by forcing the screw directly into the boss.

The yoke shell parts comprises also bearing guiding means embodied as an arc-shaped flange 211*a* and 211*b*. The bearing guiding means are adapted to hold the tilt bearing when the yoke shell parts are interlocked and functions further as a belt tensioning means as explained in connection with FIG. 4*a*-4*c*. Other embodiments of possible belt tensioning means are described in connection with FIG. 4-6.

The yoke shell parts comprise mounting guiding means adapted to support at least one component positioned within said yoke. The mounting guiding means can for instance be embodied as flanges, bosses, recesses or bores integrated into the internal side of the yoke shell part. The components can for instance be attached to these parts by using fastening means such as screws, adhesives, snap mechanisms etc. Mounting guiding means can also be shaped as partial cavities shaped to accommodate the components which are to be positioned inside the yoke. The illustrated yoke shell parts comprise mounting guiding means in the form of a recess 213*a* for accommodating the metal frame (shown in FIG. 1*b*), mounting guides such as a recess for accommodating the metal frame and a number of flanges 215*a* supporting the metal frame. The recess and flanges simplify the manufacturing process, as they make it very easy to position the metal frame in the yoke shell part.

Figures 3A, 3B:
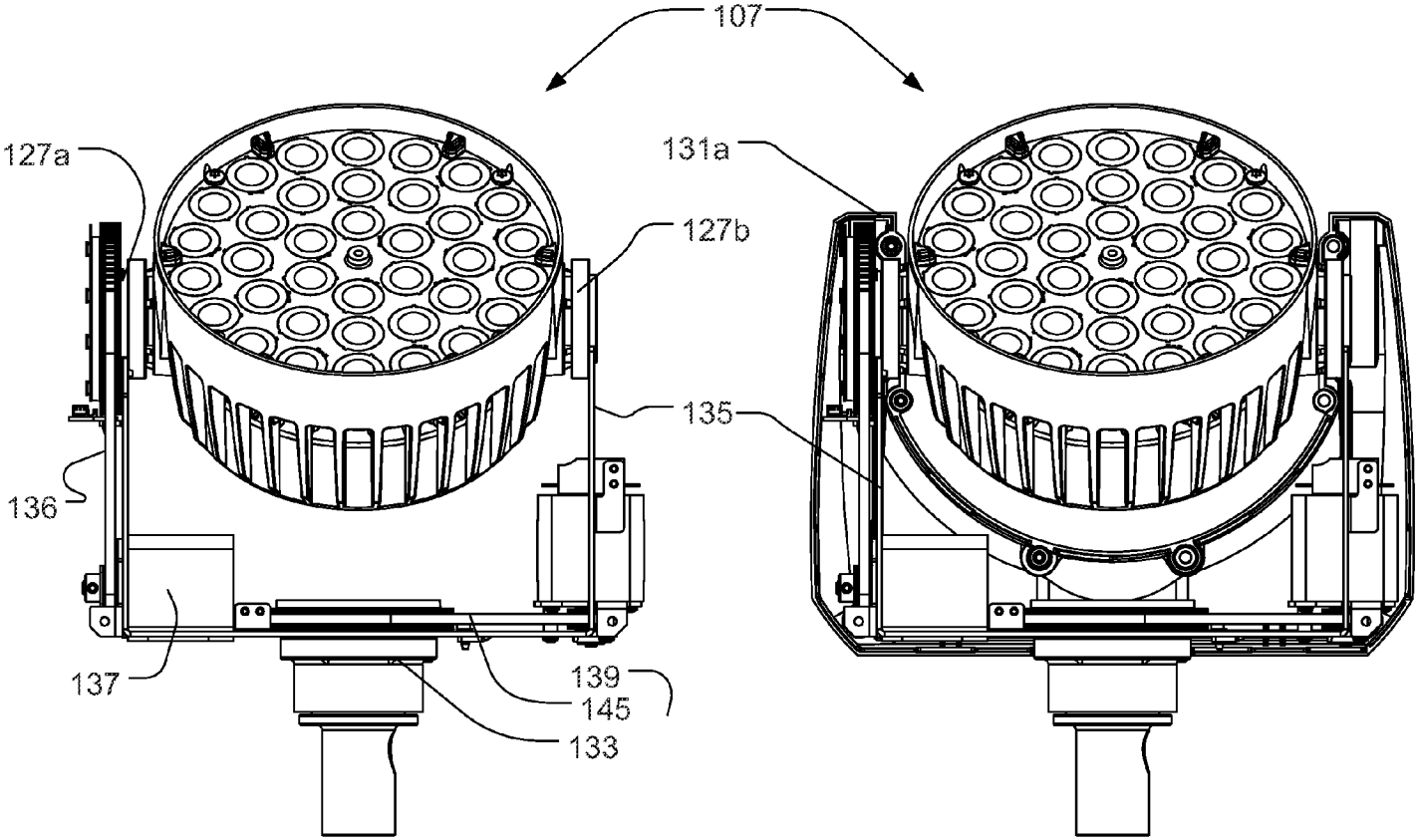
FIG. 3*a*-3*b* illustrate steps of manufacturing the illumination device of FIG. 1*a* and 1*b;*
Figures 4A, 4B, 4C:
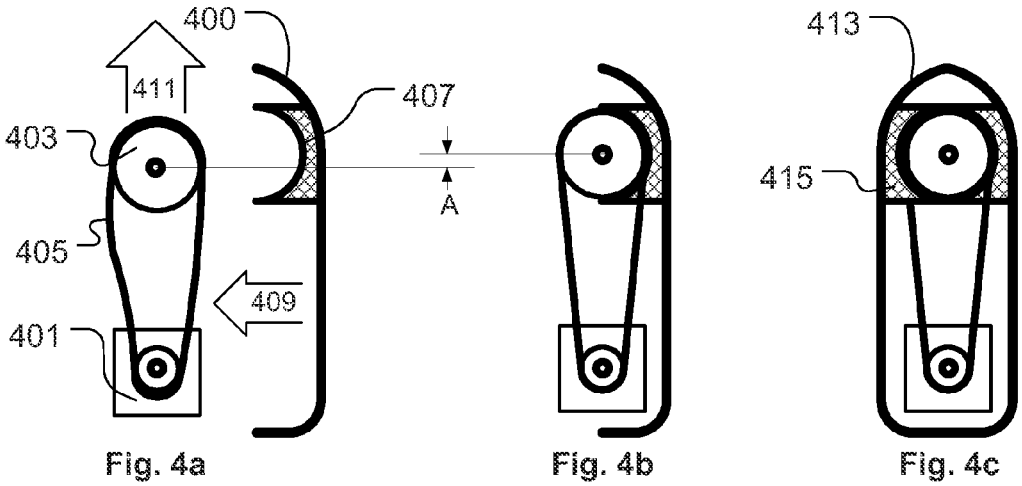
FIG. 4*a*-4*c* illustrate a first embodiment of a yoke shell part comprising belt tensioning means.

A method of manufacturing an illumination device like the illumination device illustrate in FIG. 1*a* and 1*b* can comprise the steps of providing the base, providing the yoke and providing the head. FIGS. 3*a* and 3*b* illustrate the step of providing the yoke. FIG. 3*a* illustrates that the pan motor 136 is mounted to one yoke arm and the pan bearing 133 to the bottom part of the metal frame whereafter they are connected by the pan belt 145. The tilt motor 137, tilt bearing 127*a* and tilt belt 139 are mounted on one arm of the metal frame and a second tilt bearing 127*b* is mounted on the other arm of the metal frame. The tilt bearings 127*a* and 127*b* are arranged on top of the metal frame arm, and the tilt belt 139 is connected to the tilt motor 137 and the tilt bearings 127*a*. FIG. 3*b* illustrates that at least one component can be arranged within at least one of the yoke shell parts prior to locking the two yoke shell parts together. In the illustrated embodiment this is embodied by mounting the first yoke shell part 131*a* on the metal frame 135, whereby the metal frame is arranged at least partially within the first yoke shell part 131*a*. The yoke shell part comprises belt tensioning means embodied as tilt bearing guiding means which are adapted to engage with the tilt bearings and lift the tilt bearing up from the metal frame. In the illustrated embodiment, the tilt bearing is only lifted a few millimeters and FIG. 4*a*-4*b* illustrate a simplified drawing of this functionality. The tilt belt is hereby tensioned and the tilt motor can rotate the tilt bearing and thus also the head in relation to the yoke. This reduces mounting time as the step of tensioning the tilt belt is performed as a part of the step where the first yoke shell part is mounted on the metal frame. The bearing guiding means are embodied as a number of arc-shaped flanges which are adapted to partly encircle the tilt bearing. The center of the arc-shaped flange is arranged higher in relation to the metal frame than the center of the tilt bearings in relation the metal frame, when the tilt bearing is arranged on the metal frame. Thus the tilt belt will automatically be tightened when the first yoke shell part is mounted on the metal frame. This functionality is illustrated in further detail in FIG. 4*a*-4*c*. A belt tensioning device as known in the art (for instance as disclosed in EP2103865A) can thus be eliminated, whereby both savings on the components and mounting time are achieved. The method of manufacturing comprises also the step of locking the second yoke shell part to the first shell part, whereby the yoke appears as illustrated in FIG. 1*a*. The two yoke shell parts constitute now a monocoque shell which takes up at least a part of the structural load provided to the yoke. The second yoke shell comprises also tilt bearing guiding means which serve the same function as the tilt bearing guiding means of the first yoke shell part and thus secure the tilt bearing in a position where the tilt belt is held under tension.

FIGS. 4-6 illustrate an illumination device according to the present invention and illustrates principles of different embodiment of possible belt tensioning means which can be integrated into the yoke shell part and adapted to tension a belt connecting a motor and a bearing upon mounting of the yoke shell part on the yoke. FIGS. 4-6 illustrate the principles behind the belt tensioning means and show a cross-sectional view of a yoke. It is to be understood that some components may be omitted for simplicity. The principles in FIGS. 4-6 is illustrated as belt tensioning means for a tilt drive comprising a tilt motor 401, a tilt bearing 403 and a tilt belt 405. The tilt drive is embodied in a yoke and adapted to rotate a head (not shown) in relation to the yoke. It is to be understood that similar principles can be used for any motor, bearing and belt systems, for instance a pan drive adapted to rotate the yoke in relation the base.

FIGS. 4*a*-4*c* illustrate a yoke shell part where the belt tensioning mechanism is formed as bearing guiding means adapted to displace the bearing in relation to a motor upon mounting the yoke shell part 400 to the yoke. FIG. 4*a* illustrates the setup prior mounting the yoke shell part 400, FIG. 4*b* illustrates the setup after the yoke shell part 400 has been mounted on the yoke, and FIG. 4*c* illustrates the final setup. A tilt motor 401, a tilt bearing 403 and a tilt belt 405 are, in FIG. 4*a*, arranged in relation to each other such that the tilt belt is loosely looped around the tilt motor and the tilt bearing. The tilt belt, tilt motor and tilt bearing can for instance be arranged on a metal frame (not shown) as described above or arranged in another yoke shell part (not shown). The tilt motor comprises an axis which can be rotated by the motor, as known in the art. The tilt bearing is arranged such that it is possible to displace the tilt bearing in relation to the tilt motor for instance by positioning the tilt bearing on top of a metal frame as described above. The tilt bearing can also be mounted in a mechanical guide such as a guiding slot wherein the tilt bearing can move in relation the tilt motor. The bearing guiding means is formed as an arc-shaped flange 407 which is integrated as a part of the yoke shell part 400. The yoke shell part 400 is mounted on the yoke in a direction indicated by arrow 409 and the arc-shaped flange will engage with the tilt bearing and force the tilt bearing 403 in an upward direction as indicated by arrow 411 due to the shape of the flange. The tilt bearing is thus displaced a distance A in relation to the tilt motor whereby the tilt belt 405 is tensioned as illustrated in FIG. 4*b*. A second yoke shell part 413 is mounted and locked to yoke shell part 400 in FIG. 4*c*. The skilled person realizes that the bearing guiding means alternatively can be a curved surface that engages with the tilt bearing. The second yoke shell part comprises also bearing guiding means formed as an arc-shaped flange 415 which is integrated as part of the yoke shell part 413. The bearing guiding means 415 of the second yoke shell part secures the tilt bearing in the position where the tilt belt is tight.

Figures 5A, 5B, 5C:
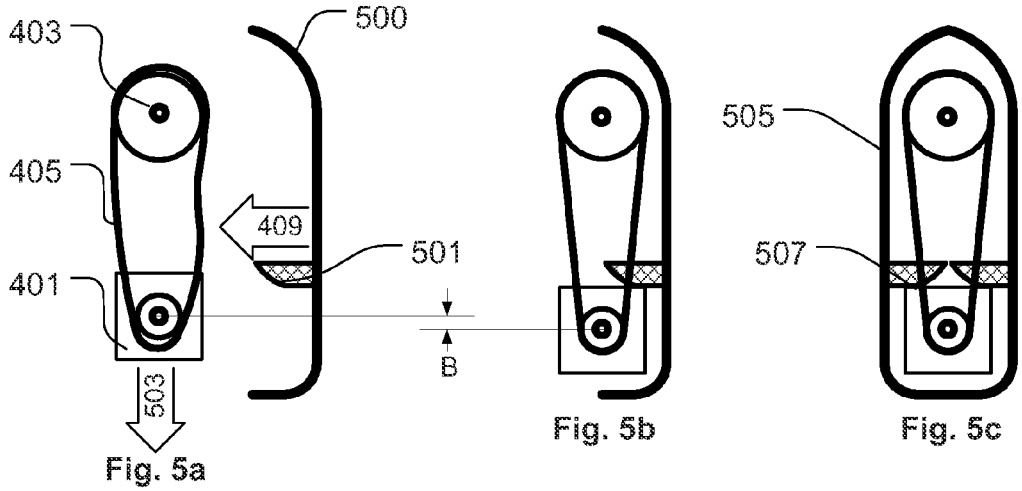
FIG. 5*a*-5*c* illustrate a second embodiment of a yoke shell part comprising belt tensioning means.
Figure 6A:
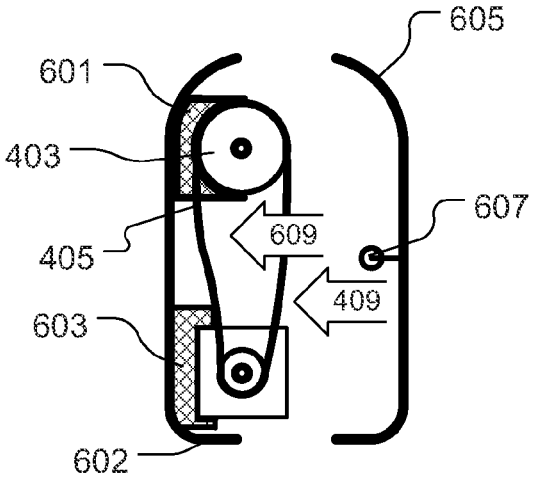
FIGS. 6*a* and 6*b* illustrate a third embodiment of a yoke shell part comprising belt tensioning means.
Figure 6B:
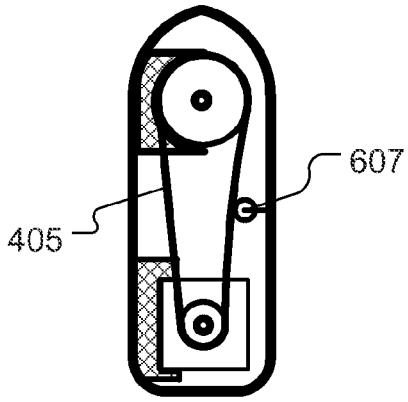

FIG. 5*a*-5*c* illustrate a yoke shell part where the belt tensioning mechanism is formed as motor guiding means adapted to displace the motor in relation to a bearing upon mounting the yoke shell part to the yoke. FIG. 5*a* illustrates the setup prior mounting the yoke shell part 500; FIG. 5*b* illustrates the setup after the yoke shell part has been mounted on the yoke and FIG. 5*c* illustrates the final setup. In this embodiment the tilt motor is arranged such that it is possible to displace the tilt motor in relation to the tilt bearing for instance by arranging a part of the tilt motor in a mechanical guide such as a guiding slot wherein the tilt motor can move in relation the tilt bearing. The motor guiding means is formed as a curved flange 501 which is integrated as part of the yoke shell part 500. The yoke shell part 500 is mounted to the yoke in a direction indicated by arrow 409 whereby the curved flange 501 will engage with the tilt motor 401 and force the tilt motor in a downward direction as indicated by arrow 503 due to the shape of the curved 501 flange. The tilt motor is thus displaced a distance B in relation to the tilt bearing whereby the tilt belt 405 is tightened as illustrated in FIG. 5*b*. In FIG. 5*c* a second yoke shell part 505 is mounted on and locked to yoke shell part 500. The second yoke shell part 505 comprises also motor guiding means formed as a curved flange 507 which is integrated as part of the yoke shell part 505. The motor guiding means 507 of the second yoke shell part helps secure the motor in a position where the tilt belt is tight FIGS. 6*a* and 6*b* illustrate a setup where the tilt bearing 403 and tilt motor 401 are arranged in a first yoke shell part 601 using mounting guiding means 602 and 603, where guiding means 602 is adapted to accommodate the tilt bearing and guiding means 603 is adapted to accommodate the tilt motor 401. The mounting guiding means can be molded as part of the first yoke shell part 601 and formed to accommodate the tilt motor and tilt bearing. The guiding means can also include a snap mechanism adapted to hold the tilt motor or the tilt bearing in the mounting guiding means. In this embodiment the belt tensioning mechanism is formed as belt guiding means adapted to displace at least a part of the belt upon mounting the second yoke shell part 605 on the yoke. The belt guiding means are embodied as a pulley 607 connected to the second yoke shell part 605. The pulley is adapted to displace a part of the tilt belt as indicated by arrow 609 by pushing to the tilt belt when the yoke shell part is mounted as indicated by arrow 409. The displacement of the tilt belt results in the fact that the path which the tilt belt follows when rotating is increased and the tilt belt is as a consequence tensioned as illustrated in FIG. 6*b*. The pulley ensures that the tilt belt can rotate without much friction, however, the skilled person realizes that the belt tensioning effect also can be achieved by a fixed mechanical mechanism without pulley. The pulley can also be spring-mounted on the yoke shell such that constant pressure is applied to the tilt belt.

Figure 10A:
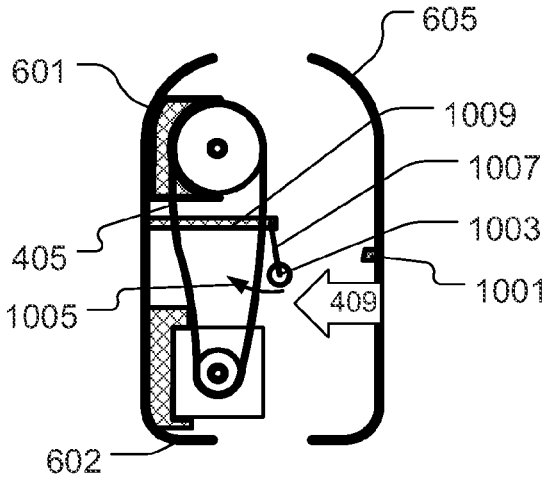
FIGS. 10*a* and 10*b* illustrate a fourth embodiment of a yoke shell part comprising belt tensioning means.
Figure 10B:
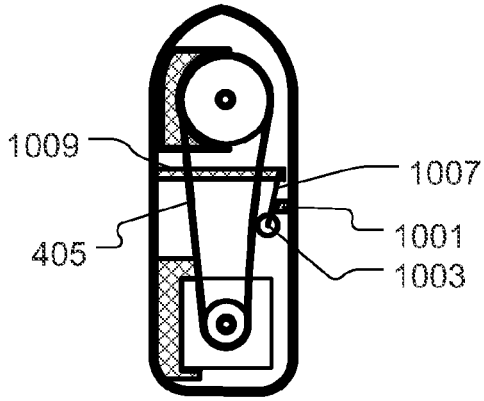

FIGS. 10*a* and 10*b* illustrate a setup similar to the one in FIG. 6*a* and FIG. 6*b* except for the fact that the belt guiding means are embodied as a protrusion 1001 inside the second yoke shell part 605. The protrusion 1001 is adapted to interact with a rotatable pulley 1003 connected to the first yoke shell part 601. The pulley displaces a part of the tilt belt as indicated by arrow 1005 by pushing on the tilt belt when the protrusion 1001 interacts with the pulley upon mounting of the yoke shell part 605 as indicated by arrow 409. The pulley 1003 is mounted on an arm 1007 which is rotatable connected to mounting guide 1009 of the yoke shell part 605. It is to be understood that the rotating pulley can be spring-loaded and also be arranged on a metal frame like the one illustrated in FIG. 1*b*.

It is to be understood that any combination of the principles illustrated in FIGS. 4-6 and 10 can be combined. The yoke shell part including belt tensioning means is illustrated in FIGS. 4-6 and 10 in connection with the a yoke which is covered by two yoke shell parts. However it is further to be understood that the principles of the belt tensioning means also can be used in connection with yokes where the yoke shell parts that comprise the belt tensioning means only covers a part of the yoke and in connection with yokes where the yoke shell parts do not support a part of the structural load applied to the yoke.

It is to be understood that the principles of the belt tensioning mechanism integrated into the yoke shell part also can be used in an illumination device comprising a light source generating a light beam where the illumination device comprises at least one housing, and where the at least one housing comprises an outer shell comprising a number of shell parts surrounding at least one motor connected to a bearing through a belt wherein said at least one of the shell parts comprises belt tensioning means adapted to tighten said belt upon mounting of the shell part to the housing. The housing can for instance be an outer housing surrounding most of the components in the illumination device. The housing can also be a modular housing functioning as an internal housing surrounding a part of the components in the illumination device. The modular housing can for instance be a zoom system where a number of optical lenses are adapted to move along an axis for instance by using a motor belt mechanism whereby this belt mechanism can for instance be tightened by a belt tensioning mechanism integrated in a shell part surrounding at least a part of the components in the zoom module.

Figure 7A:
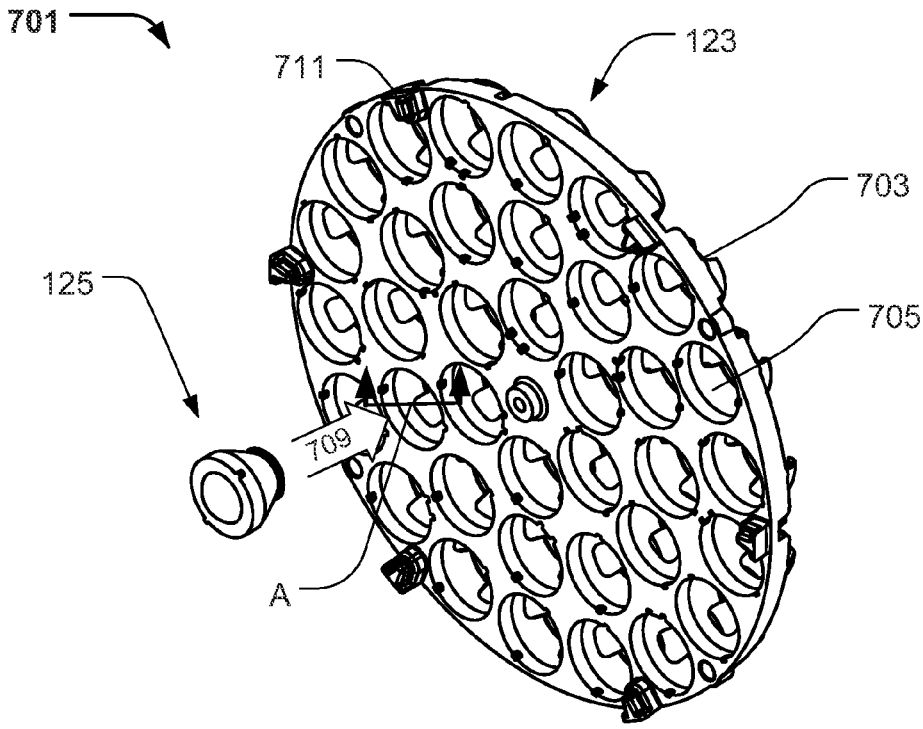
FIG. 7*a* and FIG. 7*b* illustrate a lens assembly according to one aspect of the present invention.
Figure 7B:
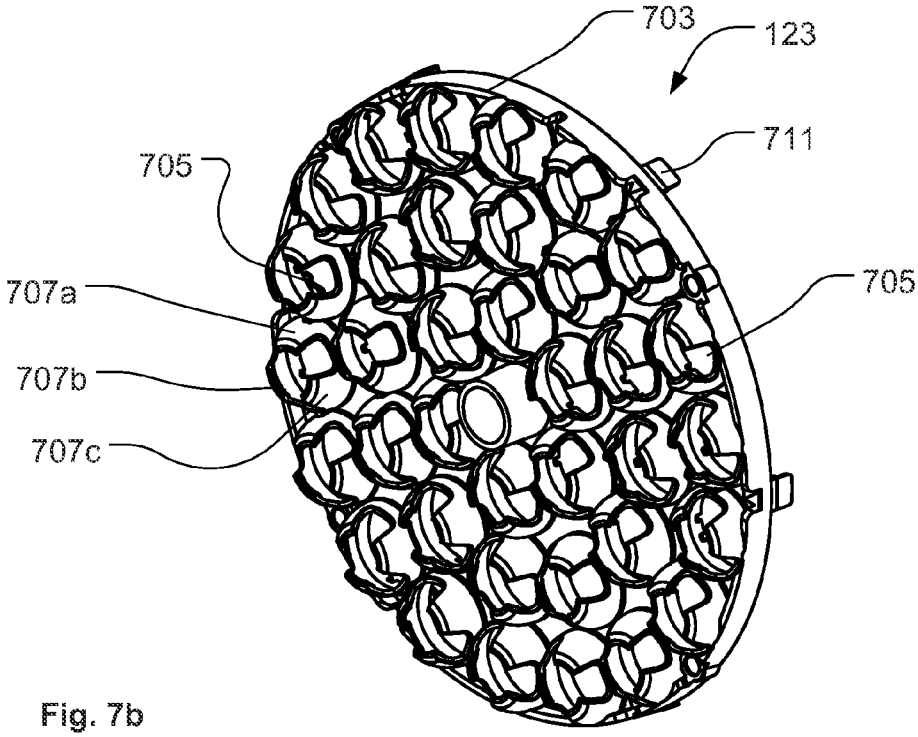

FIGS. 7*a* and 7*b* illustrate respectively a front and back perspective view of a lens assembly 701 used in the illumination device 101 illustrated in FIG. 1-3. The lens assembly comprises a number of optical lenses 125 (only one is shown for simplicity) and a lens holder 123. The lens holder comprises a mounting plate 703 having a number of holes 705 where the holes are adapted to accommodate the lenses. The lens holder comprises further a number of resilient fingers extending backward from the mounting plate and at least partially surrounding the holes. The resilient fingers will thus extend towards the light sources when the lens assembly is arranged above light sources. In the illustrated embodiment each hole is surrounded by three resilient fingers 707*a*-707*c* positioned at 120-degree intervals around the hole. The resilient fingers are adapted to engage with the lenses and secure the lenses in the holes. The lenses can as a consequence be arranged very quickly in the holes as the resilient fingers will automatically engage with the lens and secure the lens. It is to be understood that any number of resilient fingers can be used. Arrow 709 illustrates that the lens 125 can simply be inserted from the front of the lens holder. The lens holder can as a consequence be mounted onto the PCB prior to mounting the lenses which simplifies the manufacturing process since there is no need to mount a lens holder for each lens, as in prior art illumination devices. The lenses are further tightly secured as the resilient fingers 707 engage with the lenses over large areas and the lenses are hereby held in the same position even though the head of the illumination devices rotates. The resilient fingers will further not influence the outgoing light from the front of the lens as they engage with the rear side of the lens holder. In the case of TIR (Total Internal Reflection) lenses, the resilient fingers will not influence the light as they engage with the outer side of the surface were the total internal reflection takes place. The tolerance requirements related to this lens assembly are further not as strict as prior art lens holders where the lens is secured by flanges holding the front of the lens on the front side of the mounting plate. This reduces costs as the manufacturing of each component is not subject to the same strict tolerances as prior art lens assemblies. The lens holder also comprises a number of front plate/sheet supports 711 which are adapted to hold and support a front plate. A front plate/sheet can therefore be arranged in front of the lens assembly. Said front plate/sheet can for instance be formed as an additional lens part, a diffuser plate/sheet, textured glass or a color filter. The costs related to the manufacturing of such a lighting assembly are further reduced compared to prior art lighting assemblies, as both the lenses and the lens holder can be constructed by using known molding techniques.

Figure 8A:
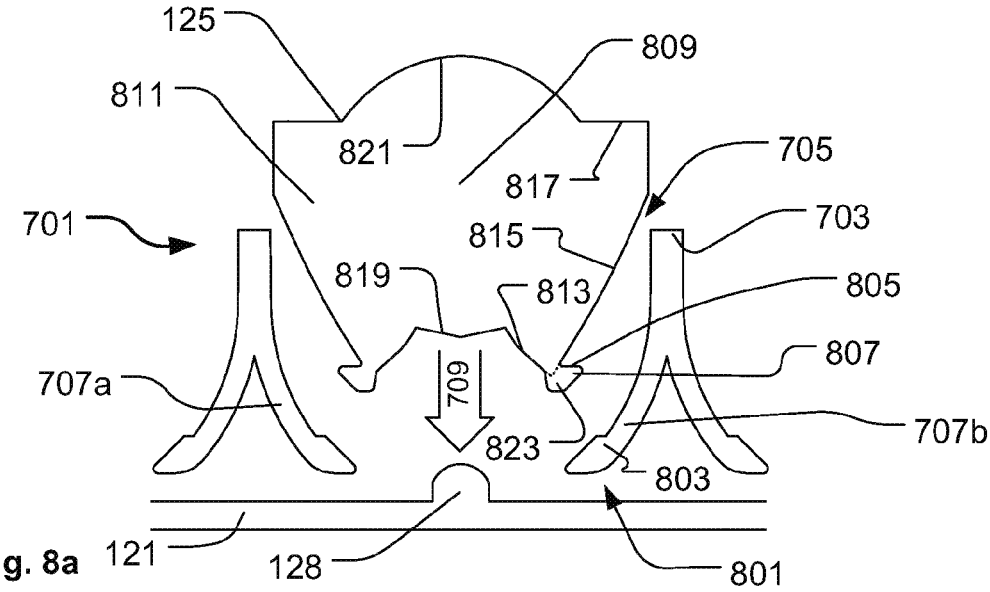
FIG. 8*a*-8*c* illustrate a cross sectional view along line A of the lens assembly in FIG. 7*a;*
Figure 8B:
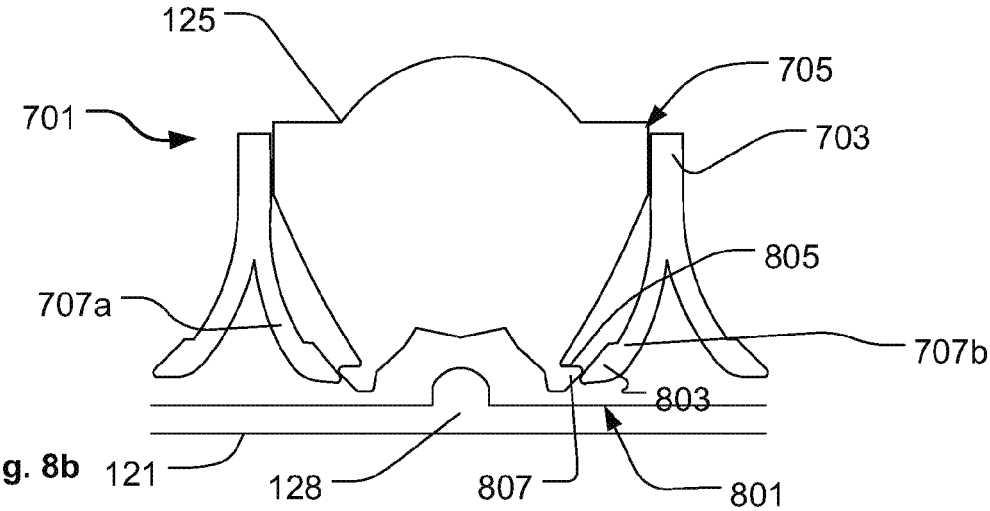
Figure 8C:
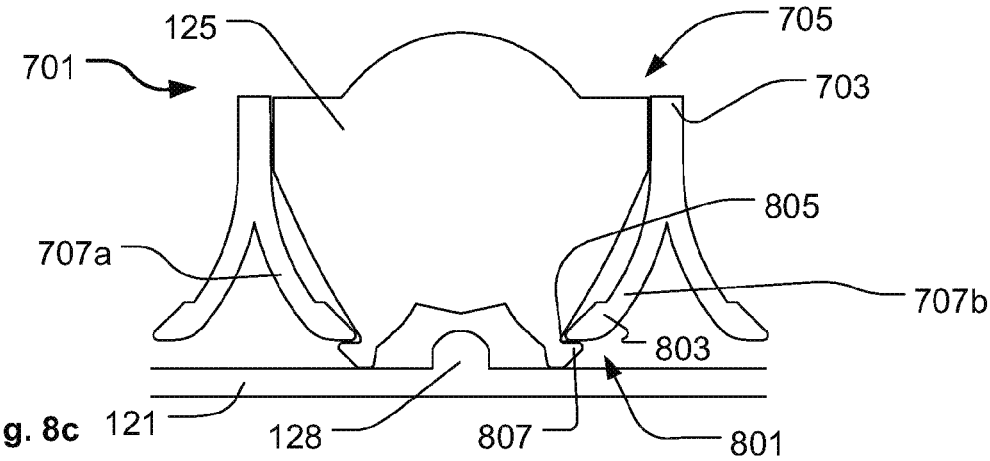

FIG. 8*a*-8*c* illustrate a cross-sectional view along line A of the lens assembly in FIG. 7*a* and illustrate how a lens 125 can be arranged in the lens holder 701. FIG. 8*a* illustrates the lens holder 701 and lens 125 before the lens is arranged in the hole, FIG. 8*b* illustrates an intermediate situation and FIG. 8*c* illustrates the final situation. The lens holder 701 is positioned above the LED PCB 121 and arranged such that the lens 125 will be arranged above an LED 128 when it is arranged in the lens holder. FIG. 8*a* illustrates that the lens 125 is inserted into the lens holder 701 from the front side as illustrated by arrow 709. The resilient fingers 707*a* and 707*b* in their neutral state are angled towards the center of said hole 705, meaning that they will bend towards the center of the hole when no force is applied to the resilient fingers. FIG. 8*c* illustrates that the hole 705 is adapted to accommodate the lens and support the top part of the lens. The resilient fingers engage with the lens through an engagement mechanism 801 comprising a first mating portion integrated into the resilient fingers 803 and a second mating portion 805 integrated into the lens. The tips of the resilient fingers constitute the first mating portion and the second mating portion 805 comprises flange 807 transversally protruding from the lens. The transversally protruding flange 807 will in the intermediate situation illustrated in FIG. 8*b* come into contact with the tip of the resilient fingers and apply a force to the resilient fingers. The resilient fingers will as a consequence bend away from their neutral state and allow the transversally protruding flange 807 to pass. The transversally protruding flange and tips of the fingers will engage once the transversally protruding flange has passed the tip of the resilient fingers, and in this position the transversally protruding flange 807 and the resilient fingers 707*a* and 707*b* are adjacent to each other. The lens is formed such that the cross-sectional dimensions of the lens decrease in a direction backwards from said front plate. The tip of the resilient fingers will as a consequence be locked by the transversally protruding flange 807 and the edges of the lens.

The lens is as illustrated in FIG. 8*a* a light collector which collects light emitted from the LED 128 and converts the collected light into a light beam. The light collector comprises a central lens part 809 aligned along the optical axis of the LED and a peripheral lens part 811 surrounding at least a part of the central lens 809. The peripheral lens part comprises a peripheral entrance surface 813, a peripheral reflection surface 815 and a peripheral exit surface 817. The peripheral part of the light emitted by the light source enters the peripheral lens part through the peripheral entrance surface and is reflected by the peripheral reflection surface before leaving the peripheral lens through the peripheral exit surface 817. The central lens part comprises a central entrance surface 819 and a central exit surface 821. A central part of the light emitted by the light source enters the central lens through the central entrance surface 819 and leaves the central lens through the central exit surface 821. The lens 125 can be formed to create a light beam having a desired beam divergence for instance a positive beam divergence in order to create a wide light beam, a substantially zero beam divergence in order to create a parallel light beam or a negative beam divergence in order to focus the light beam, as known in the art of optical design. The transversally protruding flange 807 protrudes from the peripheral reflection surface 815 and is positioned in the lower part of the lens and the influence of the transversally protruding flange is thus very limited. The transversally protruding flange has further a laterally protruding part 823 which protrudes downwards from the peripheral entrance surface. This improves the strength of the transversally protruding flange. The first mating portion integrated into the resilient fingers will thus engage with the peripheral reflection surface and the transversally protruding flange and lock the lens in the lens holder.

Figure 9A:
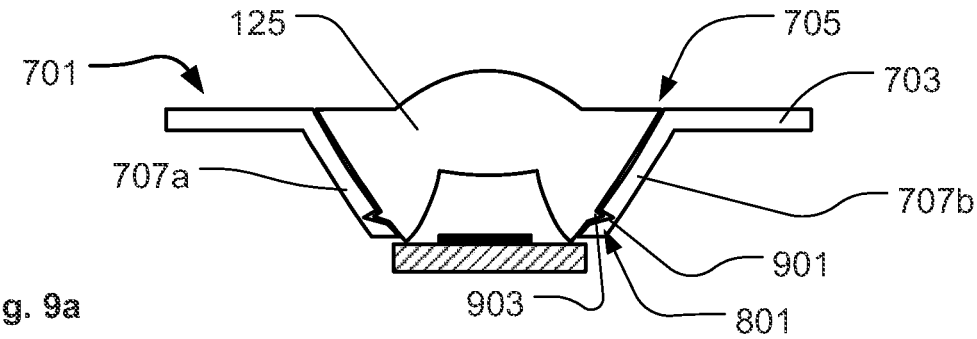
FIG. 9*a*-9*c* illustrate a cross sectional view of the different lens assemblies.
Figure 9B:
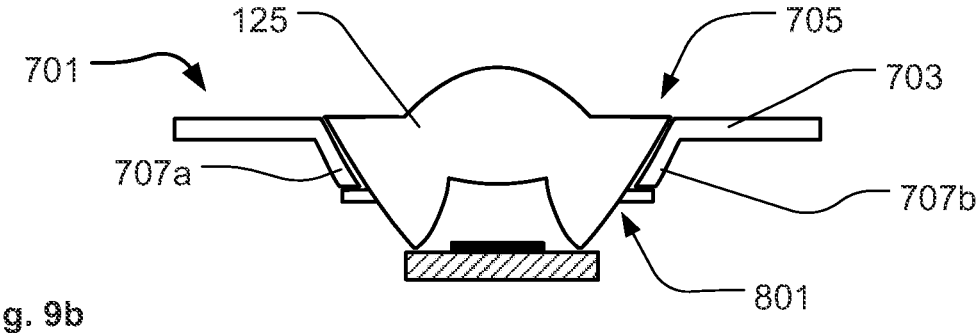
Figure 9C:
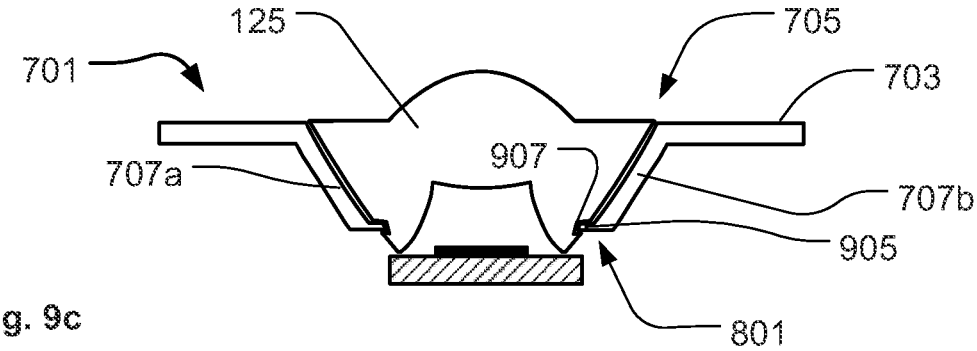

FIG. 9*a*-9*c* illustrate a cross-sectional view of a lens and lens holder and show different embodiments of the engagement mechanism 801 comprising a first mating portion integrated into the resilient fingers and a second mating portion integrated into the lens. In FIG. 9*a*, the first mating portion is embodied as a recess 901 in the resilient fingers and the second mating part is embodied as a protruding part 903 which is adapted to fit into the recess 901. FIG. 9*b* illustrates that the flange 807 transversally protruding from the lens also can be positioned at a higher position on the lens and that the resilient fingers in this embodiment are shorter. FIG. 9*c* illustrates an embodiment where the first mating parts integrated into the resilient fingers are embodied as an inwardly protruding flange 905 adapted to fit into a recess 907 in the lens. In this embodiment, the recess in the lens constitutes the second mating portion.

The invention claimed is:

1. An illumination device comprising:

a light source array comprising a number of light sources, a lens assembly positioned above said light source array, said lens assembly comprises a number of optical TIR lenses and a lens holder, wherein:

each of said optical TIR lenses comprises a central lens part and a peripheral lens part, the central lens part comprises a central entrance surface and a central exit surface and the peripheral lens part surrounds at least a part of the central lens part and comprises a peripheral entrance surface, a peripheral reflection surface and a peripheral exit surface; and said lens holder comprises a mounting plate having a number of holes, said number of holes being adapted to accommodate said optical TIR lenses;

wherein at least one of said holes is at least partially surrounded by a number of resilient fingers extending from said mounting plate and towards said light sources, a tip of said resilient fingers comprising a first mating portion and said peripheral reflection surface comprising a second mating portion, said first mating portion and said second mating portion adapted to engage each other such that each of said optical TIR lenses is secured in relation to one of said holes and arranged above at least one of said light sources.

2. The illumination device according to claim 1 wherein said resilient fingers in a neutral state are angled towards a center of said respective hole.

3. The illumination device according to claim 1 wherein said second mating portion is integral to said peripheral reflection surface and comprises an outward protruding flange.

4. The illumination device according to claim 3 wherein said first mating portion integrated into said tip of said resilient fingers is adapted to engage said outward protruding flange, which protrudes from a lower part of the optical TIR lens.

5. The illumination device according to claim 4 wherein the protruding flange further comprises a laterally protruding part, which protrudes from the peripheral entrance surface.

6. The illumination device according to claim 1 wherein said optical TIR lenses are formed such that the cross-sectional dimension of said optical TIR lenses decreases in a direction backwards from said mounting plate.

7. The illumination device according to claim 1 where said illumination device further comprises:

a base;

a yoke connected to and rotatable relative to said base;

a head connected to and rotatable relative to said yoke, said head comprises said light source array and said lens assembly.

8. A method of manufacturing an illumination device, where said illumination device comprises:

a light source array comprising a number of light sources;

a lens assembly positioned above said light source array, said lens assembly comprises a number of optical TIR lenses and a lens holder, wherein:

each of said optical TIR lenses comprises a central lens part and a peripheral lens part, the central lens part comprises a central entrance surface and a central exit surface and the peripheral lens part surrounds at least a part of the central lens part and comprises a peripheral entrance surface, a peripheral reflection surface and a peripheral exit surface; and said lens holder comprises a mounting plate having a number of holes, said number of holes being adapted to accommodate said optical TIR lenses;

said method comprises the steps of:

positioning said lens holder above said light sources, such that said holes are arranged above said light sources;

arranging said optical TIR lenses in said holes and above said light sources;

wherein said step of arranging said optical TIR lenses in said holes comprises the step of:

engaging a lens mating portion of said peripheral lens part of said lens with at least one holder mating portion of a tip of a resilient finger extending from said lens holder and towards said light source.

9. The method of manufacturing an illumination device according to claim 8 wherein said steps engaging each of said optical TIR lenses with at least one resilient finger comprises the steps of:

forcing said at least one resilient finger out of a natural state of said resilient finger; and locking said holder mating portion of said resilient finger with said lens mating portion of said lens.

10. A lens assembly for an illumination device, said lens assembly comprises a number of optical TIR lenses and a lens holder, wherein:

each of said optical TIR lenses comprises a central lens part and a peripheral lens part, the central lens part comprises a central entrance surface and a central exit surface and the peripheral lens part surrounds at least a part of the central lens part and comprises a peripheral entrance surface, a peripheral reflection surface and a peripheral exit surface; and said lens holder comprises a mounting plate having a number of holes, said number of holes being adapted to accommodate said optical TIR lenses wherein at least one of said holes is at least partially surrounded by a number of resilient fingers extending backward from said mounting plate, a tip of said resilient fingers comprising a first mating portion and said peripheral reflection surface or peripheral entrance surface comprises a second mating portion, said first mating portion and said second mating portion adapted to engage each other such that each of said optical TIR lens is secured in relation to one of said holes and above at least one of said light sources.

11. The lens assembly according to claim 10 wherein said resilient fingers in a neutral state are angled towards a center of said respective hole.

12. The lens assembly according to claim 10 wherein said second mating portion is integral to said peripheral reflection surface or said peripheral entrance surface and comprises a protruding flange.

13. The lens assembly according to claim 12 wherein said first mating portion integrated into said tip of said resilient fingers is adapted to engage said protruding flange, which protrudes from a lower part of the optical TIR lens.

14. The lens assembly according to claim 10 wherein the said optical TIR lenses are formed such that the cross-sectional dimensions of said optical TIR lenses decrease in a direction backwards from said mounting plate.

15. The illumination device according to claim 10 wherein said second mating portion is a flange protruding from said peripheral reflection surface and from said peripheral entrance surface.

16. The illumination device according to claim 4 wherein said second mating portion is a flange protruding from a lower part of the optical TIR lens.

* * * * *